US008967681B2

(12) United States Patent
Masumoto et al.

(10) Patent No.: US 8,967,681 B2
(45) Date of Patent: Mar. 3, 2015

(54) LOCKING APPARATUS FOR OPENABLE WINDOW

(75) Inventors: Koji Masumoto, Sakai (JP); Ryuji Kitagawa, Sakai (JP)

(73) Assignee: Kubota Corporation, Osaka (JP)

( * ) Notice: Subject to any disclaimer, the term of this patent is extended or adjusted under 35 U.S.C. 154(b) by 171 days.

(21) Appl. No.: 13/602,593

(22) Filed: Sep. 4, 2012

(65) Prior Publication Data

US 2013/0234452 A1 Sep. 12, 2013

(30) Foreign Application Priority Data

Nov. 25, 2011 (JP) ..... 2011-257983

(51) Int. Cl.

| | |
|---|---|
| ***E05C 3/04*** | (2006.01) |
| ***E05C 3/14*** | (2006.01) |
| ***E05C 17/50*** | (2006.01) |
| ***E05B 15/02*** | (2006.01) |
| *E05C 3/02* | (2006.01) |
| *E05C 3/06* | (2006.01) |

(52) U.S. Cl.

CPC ..... *E05C 3/145* (2013.01); *E05C 3/043* (2013.01); *E05C 17/50* (2013.01); *E05B 15/021* (2013.01); *Y10S 292/06* (2013.01); *Y10S 292/20* (2013.01)

USPC ..... 292/202; 292/194; 292/195; 292/200; 292/DIG. 6; 292/DIG. 20

(58) Field of Classification Search

CPC ..... B60J 1/14; B60J 7/05; B60J 7/1642

USPC ..... 292/1, 194, 195, 196, 198, 200, 202, 292/203, 208, 210, DIG. 20, DIG. 35, 292/DIG. 4, 7, 146.16, 224, 218; 70/89, 90; 49/394

See application file for complete search history.

(56) References Cited

U.S. PATENT DOCUMENTS

| | | | | |
|---|---|---|---|---|
| 1,596,935 | A * | 8/1926 | Marshall | 160/211 |
| 2,249,762 | A * | 7/1941 | Hogan | 455/74 |
| 3,694,016 | A * | 9/1972 | Scallan | 292/200 |
| 3,876,237 | A * | 4/1975 | Hayes et al. | 292/202 |
| 4,124,239 | A * | 11/1978 | Horton | 292/210 |
| 4,181,333 | A * | 1/1980 | Stelma | 292/66 |
| 4,819,985 | A * | 4/1989 | Williams | 296/218 |
| 6,694,675 | B1 * | 2/2004 | Craft et al. | 49/339 |

FOREIGN PATENT DOCUMENTS

JP 2005146781 A 6/2005

* cited by examiner

*Primary Examiner* — Kristina Fulton
*Assistant Examiner* — Faria Ahmad
(74) *Attorney, Agent, or Firm* — The Webb Law Firm

(57) ABSTRACT

A locking apparatus for an openable window disposed in a cabin provided with a beam that has a first face and a second face includes a lock main body that is attached to the first face so as to be swingable between a closed position and a half-closed position, and a half-lock striker that is disposed on the lock main body. The half-lock striker is engageable with an operation piece provided on the openable window when the lock main body is at the half-closed position. The half-lock striker is positioned on a second face side of the beam at the closed position.

10 Claims, 6 Drawing Sheets

LOCKING APPARATUS FOR OPENABLE WINDOW

BACKGROUND OF THE INVENTION

1. Field of the Invention

The present invention relates to a locking apparatus for an openable window that is disposed in a cabin provided with a beam.

2. Description of the Related Art

JP 2005-146781A discloses a window opening and closing apparatus in a cabin that is provided with an openable window and a locking arm, wherein the openable window can be opened and closed while being swingably supported on a frame forming the cabin, and the locking arm locks this openable window in a half-closed state. This window opening and closing apparatus is provided for an openable window functioning as a rear window of a tractor cabin. The window opening and closing apparatus is provided with the locking arm that is swingably supported on an upper face of a lower frame (a beam made of square pipe). The front end side of the locking arm has a half-lock striker that locks the rear window in a half-closed state, and the base end side has a full-lock striker that locks the rear window in a fully-closed state (closed state). A swinging axis of the locking arm is in a direction orthogonal to a longitudinal direction of the lower frame (a normal direction of the frame upper face). With such a configuration, when the half-lock striker and the rear window become engaged with each other by the rotation of the locking arm along the upper face of the lower frame, the rear window is locked in the half-closed state. Furthermore, when the full-lock striker and the rear window become engaged with each other, the rear window is locked in the fully-closed state.

However, according to the apparatus described in JP 2005-146781A, the locking arm extends along the upper face of the lower frame when the rear window is in the fully-closed state. That is to say, the locking arm is positioned on the upper side of the lower frame throughout the full length of the locking arm, and, thus, this locking arm obstructs rear vision.

In view of these circumstances, there is a demand for a locking apparatus in a cabin, which, to the fullest extent possible, does not obstruct vision through an openable window that is to be locked.

SUMMARY OF THE INVENTION

The present invention is directed to a locking apparatus for an openable window disposed in a cabin provided with a beam that has a first face and a second face, comprising: a lock main body that is attached to the first face so as to be swingable about a center of a swinging shaft formed on a first face side of the beam between a closed position and a half-closed position; a full-lock striker that is engageable with an operation piece provided on the openable window, when the lock main body is at the closed position; and a half-lock striker that is disposed on the lock main body at a point farther from the center of the swinging shaft than is the full-lock striker, the half-lock striker being engageable with the operation piece when the lock main body is at the half-closed position, and being positioned on a second face side of the beam when the lock main body is at the closed position.

With the locking apparatus, when shifting the lock main body to the closed position in order to fully close the openable window, the half-lock striker of the lock main body is positioned on the second face side. Accordingly, constituent components of the locking apparatus present on the first face side can be reduced in number compared with those in conventional apparatuses. When the first face is taken as one frame side of the vision frame, vision through that vision frame is improved.

According to a preferred embodiment of the present invention, the lock main body includes a flange portion that is coupled to the swinging shaft, and an arm portion that connects the flange portion and the half-lock striker, and the arm portion is positioned on the second face side when the lock main body is at the closed position, and is positioned on a side opposite the second face when the lock main body is at the half-closed position. It is more preferable that the arm portion, together with the half-lock striker, surrounds the beam when the lock main body is at the closed position. When the arm portion of the lock main body and the half-lock striker are shaped in this manner, the locking apparatus at the closed position is made compact, so that the space around the locking apparatus is not obstructed.

According to a preferred embodiment, the arm portion of the lock main body is configured by a first arm portion that is positioned on the first face side, and a second arm portion that extends so as to be bent from the first arm portion, the first arm portion has a first stopper face for positioning the lock main body at the half-closed position through contact with the beam, and the second arm portion has a second stopper face for positioning the lock main body at the closed position through contact with the beam. With this configuration, the closed position and the half-closed position can be easily and accurately set.

DETAILED DESCRIPTION OF PREFERRED EMBODIMENTS

Hereinafter, a preferred embodiment of the present invention will be described with reference to the drawings.

In this embodiment, a locking apparatus 23 is applied to a rear openable window 20 of a cabin 6 that is installed in a tractor. The openable window 20 is configured by a curved glass sheet whose peripheral edge is attached with a sealing member made of elastic rubber. Hereinafter, this openable window 20 is referred to as a "rear glass 20".

Figure 1:
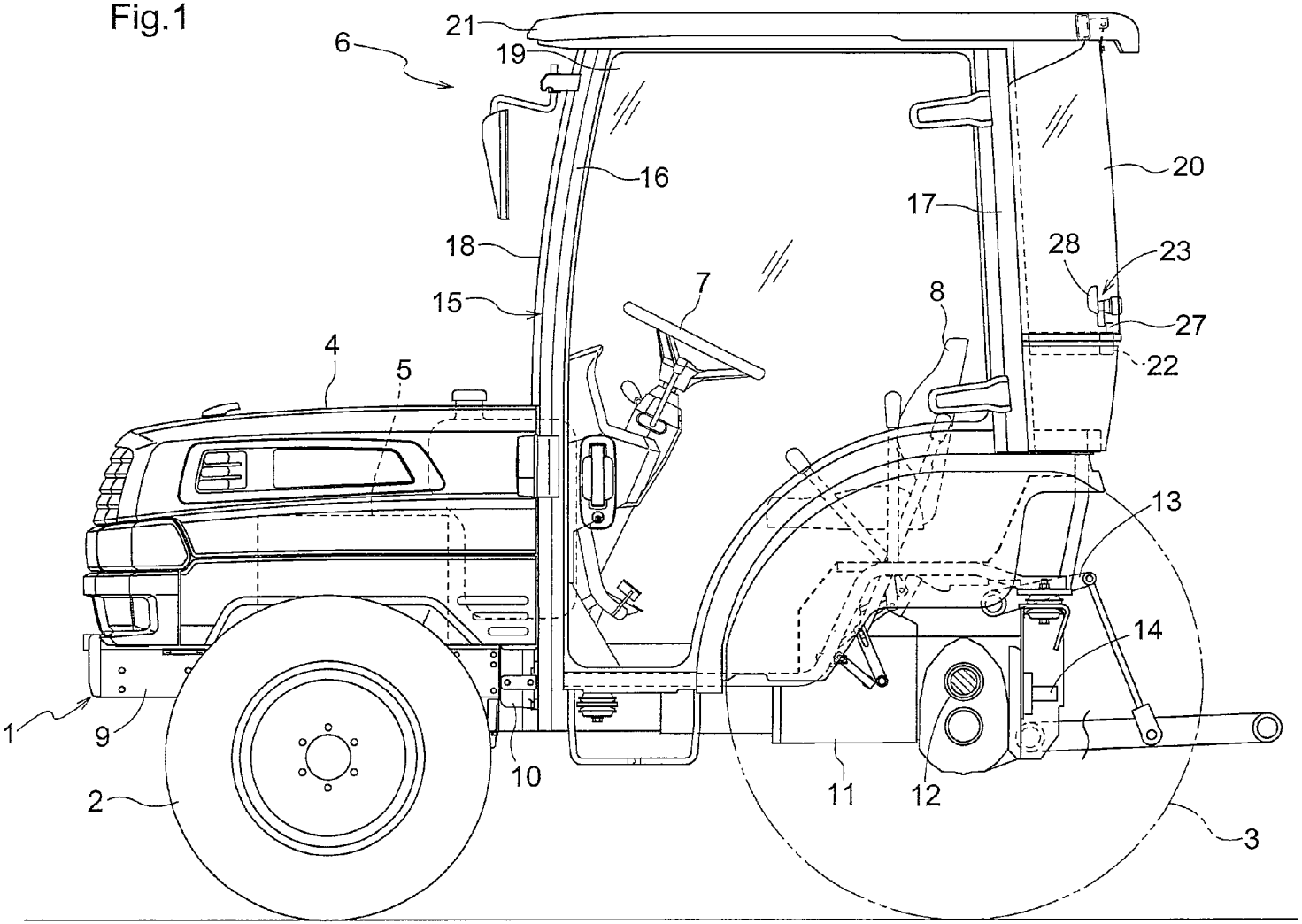
FIG. 1 is a side view showing a tractor provided with a locking apparatus.

As shown in FIG. 1, the tractor is provided with a traveling chassis 1. The traveling chassis 1 has right and left front wheels 2 and right and left rear wheels 3. A front portion of the traveling chassis 1 has a hood 4. An engine 5 is disposed below the hood 4. A rear portion of the traveling chassis 1 has the cabin 6. A steering wheel 7 and a driver's seat 8 are arranged in the cabin 6.

Furthermore, right and left front frames 9 extend forward from lower side portions of the engine 5. The front frames 9 are provided with a front axle case (not shown) that supports the front wheels 2. Furthermore, a rear portion of the engine 5 is coupled to a clutch housing 10, a transmission case 11, and a rear axle case 12 that supports the rear wheels 3. Right and left lift arms 13 and a PTO shaft 14 are arranged behind the transmission case 11.

Figure 2:
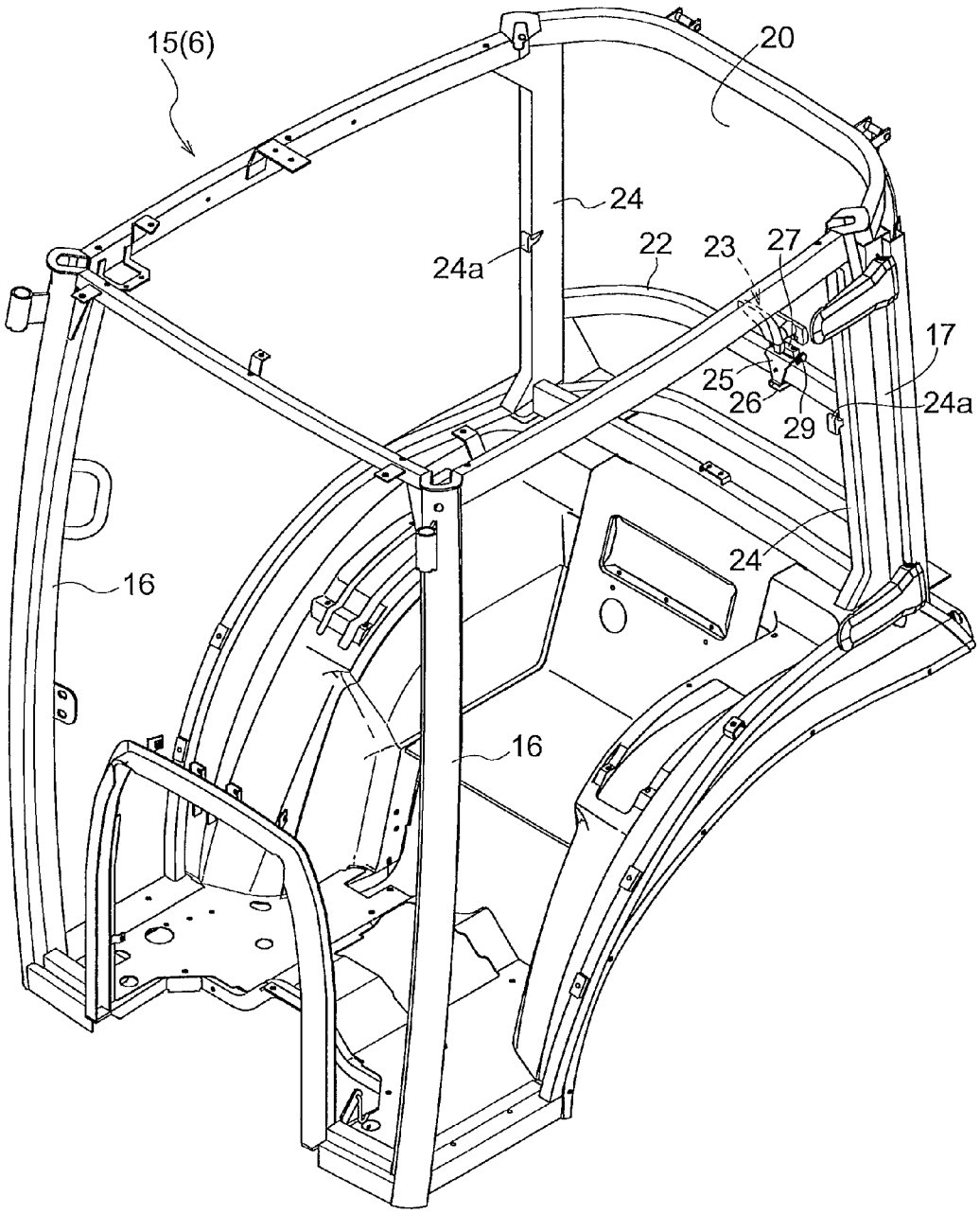
FIG. 2 is a perspective view showing a cabin frame.
Figure 3:
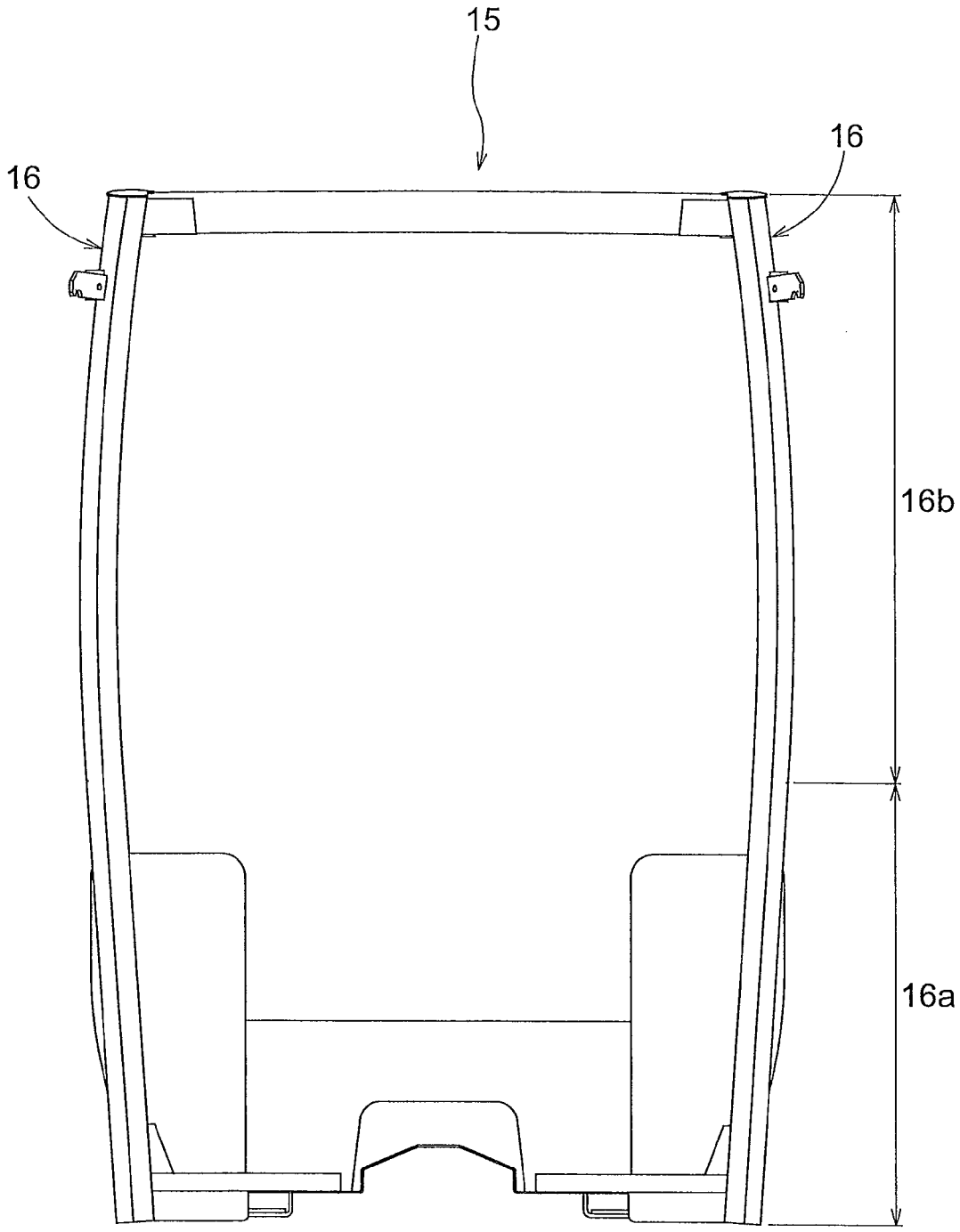
FIG. 3 is a front view showing the cabin frame.

As shown in FIGS. 1, 2, and 3, the cabin 6 is provided with a cabin frame 15 made of a profile beam such as a square pipe. The cabin frame 15 is a so-called four-column structure having right and left front support columns 16 and right and left rear support columns 17. A front glass 18, right and left side glasses 19, the above-described rear glass 20, and a roof 21 are attached to the cabin frame 15. The right and the left side glasses 19 can be opened and closed with their rear portions being swingably supported. Furthermore, the rear glass 20 can be opened and closed, and its upper portion is swingably supported on the cabin frame 15. The rear glass 20 is opened by being swung outward from a closed position, and is closed by being swung inward from an opened position. As clearly shown in FIGS. 4 and 5, a beam 22 made of, in this embodiment, square pipe (a type of profile beam) in the shape of an arch in conformity with a lower end shape of the rear glass 20 is attached to lower portions of the right and the left rear support columns 17. The beam 22 has an upper face corresponding to a first face, a lower face corresponding to a second face, an inner face corresponding to a third face, and an outer face corresponding to a fourth face. The locking apparatus 23 is disposed between the beam 22 and a lower end region of the rear glass 20.

As shown in FIG. 3, the front support columns 16 each have a straight line portion 16*a* and an arc-shaped portion 16*b*. The straight line portion 16*a* is formed in the shape of a straight line that extends upward while being inclined outward in a front view. The arc-shaped portion 16*b* is formed in the shape of an arc that continues from the upper end portion of the straight line portion 16*a* and is curved so as to be convex outward. The straight line portion 16*a* and the arc-shaped portion 16*b* are connected to each other at a point in a lower portion of the front support column 16 (portion lower than the center of the front support column 16 in the upper-lower direction). With this configuration, the width between the right and the left front support columns 16 increases at the height near the eyes of the driver who is sitting in the driver's seat 8, and, thus, the front vision can be improved.

Figure 4:
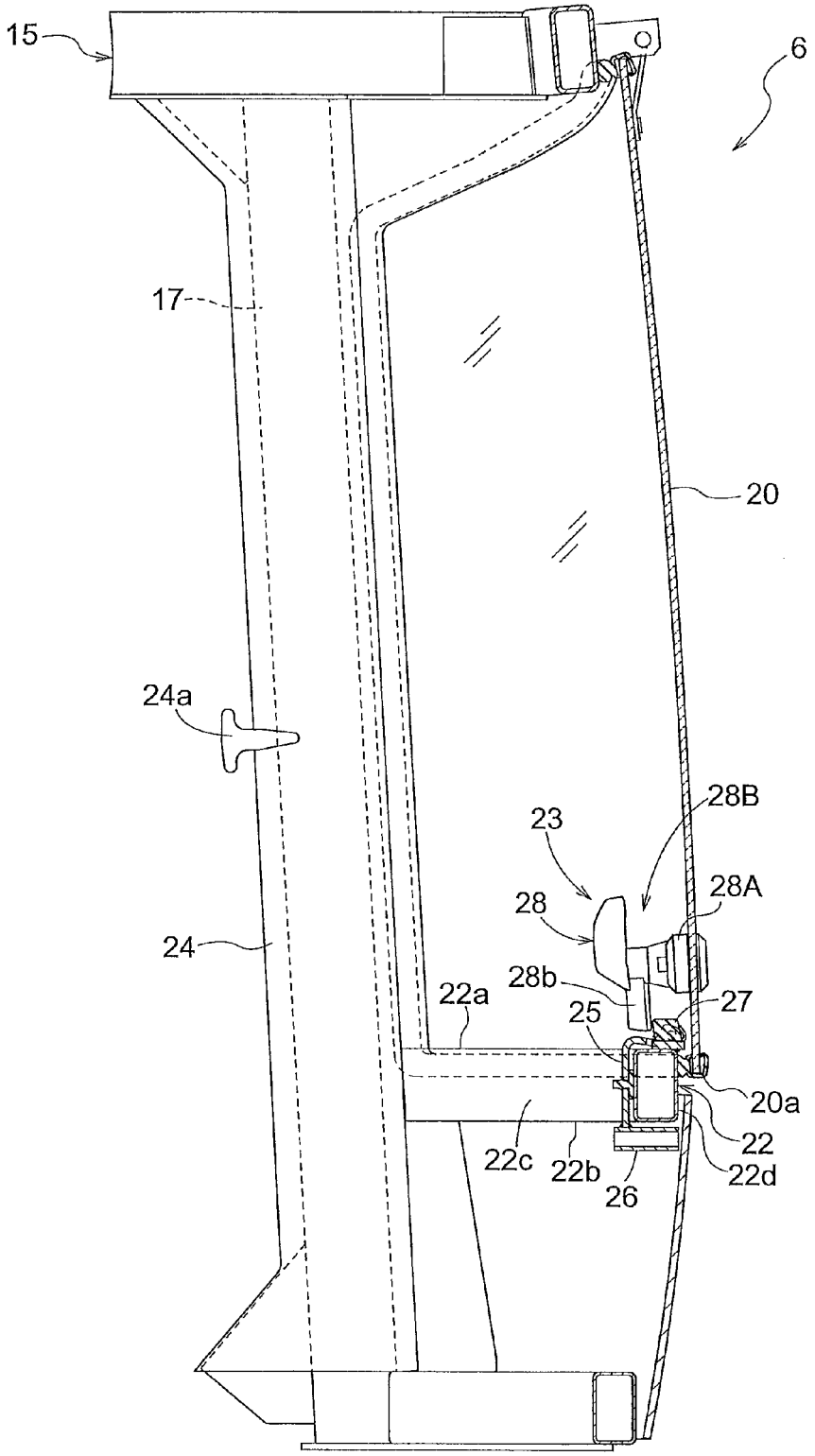
FIG. 4 is a side cross-sectional view showing a rear support column.

As shown in FIG. 4, the rear support columns 17 are each covered by a rear support column cover (garnish) 24 made of resin. A hook 24*a* made of resin is integrally formed on the rear support column cover 24. A bag, a coat, and the like can be hooked on the hook 24*a*. The hook 24*a* and the rear support column cover 24 are formed in a vertically symmetrical shape. With this configuration, since the rear support column cover 24 and the hook 24*a* are integrally made of resin, these constituent components can be produced at a low cost. Furthermore, since the hook 24*a* and the rear support column cover 24 are in a vertically symmetrical shape, the rear support column cover 24 attached with the hook 24*a* can be commonly used for the left and the right columns.

Next, the locking apparatus 23 will be described with reference to FIGS. 5 to 8.

As shown in FIGS. 5 to 8, the locking apparatus 23 is provided with a lock main body 25, a half-lock striker 26, a full-lock striker 27, and a handle 28.

The handle 28 includes a base portion 28A that is fixed to a glass face of the rear glass 20 and an operation portion 28B that is disposed on the cabin side. The operation portion 28B is supported rotatably about a swinging axis Z formed in the base portion 28A. The swinging axis Z extends orthogonal to the glass face of the rear glass 20. The operation portion 28B has a handle arm 28*a* that is in the shape of a lever and an operation piece 28*b* that extends in a radial direction relative to the swinging axis Z. The handle arm 28*a* extends in a radial direction relative to the swinging axis Z, but is curved in a direction away from the glass face of the rear glass 20 in order to increase the space between the handle arm 28*a* and the rear glass 20 and to make it easy to grip the handle arm 28*a*. The operation piece 28*b* also extends in a radial direction of the swinging axis Z, but is shifted from the handle arm 28*a* by an angle of approximately 45 degrees.

The full-lock striker 27 is a block member in the shape of an approximately rectangular solid, and is fixed to an upper face 22*a* corresponding to the first face of the beam 22 made of square pipe. The full-lock striker 27 is oriented so as to extend in the longitudinal direction (direction of an axis X) of the beam 22, and is positioned so as to be able to be in contact with the operation piece 28*b* of the handle 28 on the rear glass 20 at the closed posture.

A pair of left and right support portions 29 are fixed to the upper face 22*a* of the beam 22 so as to sandwich the full-lock striker 27 in the longitudinal direction. The support portions 29 function as bearing brackets of a swinging shaft 29*a* having a swinging axis X. Caps 30 are attached to the respective support portions 29.

The lock main body 25 is supported on the support portions 29 so as to be swingable about the swinging axis X between a closed position and a half-closed position. The lock main body 25 has an arm portion 25A that is in the shape of a plate bent substantially at 90 degrees, and flange portions 25*d* that are coupled to the swinging shaft 29*a* at the front end side of the arm portion 25A. The flange portions 25*d* are each a tongue piece bent from the arm portion 25A at 90 degrees. The arm portion 25A has a first arm portion 25*a* that is, at the closed position, positioned on the upper face 22*a* (first face) side of the beam 22, and a second arm portion 25*b* that extends so as to be bent from the first arm portion 25*a* substantially at 90 degrees. The half-lock striker 26 is fixed to the free end of the second arm portion 25*b*.

The half-lock striker 26 is formed by folding a plate material in an approximate U-shape. That is to say, the half-lock striker 26 has a convexly curved bottom plate 26*a* that is curved outward, and a pair of flat plate portions 26*b* that are arranged with the convexly curved bottom plate 26*a* interposed therebetween. The second arm portion 25*b* of the lock main body 25 is coupled to the outer face of one of the flat plate portions 26*b*. The half-lock striker 26 is positioned such that the opening of the U-shaped cross-section faces a side (left in this embodiment) of the traveling chassis 1. In other words, as clearly shown in FIG. 6, the opening of the U-shaped cross-section of the half-lock striker 26 extends in the transverse direction of the beam 22.

When the lock main body 25 is at the closed position (see FIG. 6), the arm portion 25A has a shape that, together with the half-lock striker 26, surrounds the beam 22, specifically, the upper face 22*a*, an inner face 22*c*, and a lower face 22*b* of the beam 22. When the lock main body 25 is at the closed position, the first arm portion 25*a* opposes the upper face 22*a*, the second arm portion 25*b* opposes the inner face 22*c*, and the half-lock striker 26 opposes the lower face 22*b*, and, thus, the rear glass 20 can be freely opened and closed. When the rear glass 20 comes to the closed position in a state where the lock main body 25 is at the closed position, the operation piece 28*b* of the handle 28 is positioned such that its face opposing the rear glass 20 can be engaged with the inner face of the full-lock striker 27.

Figure 7:
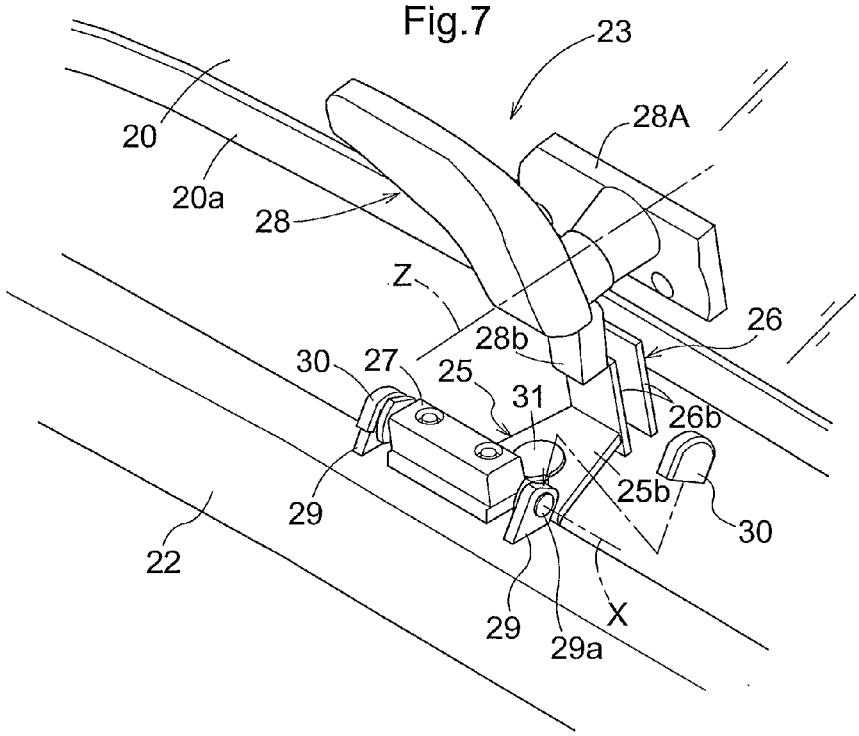
FIG. 7 is a perspective view showing the locking apparatus when the openable window is in a half-closed state.
Figure 8:
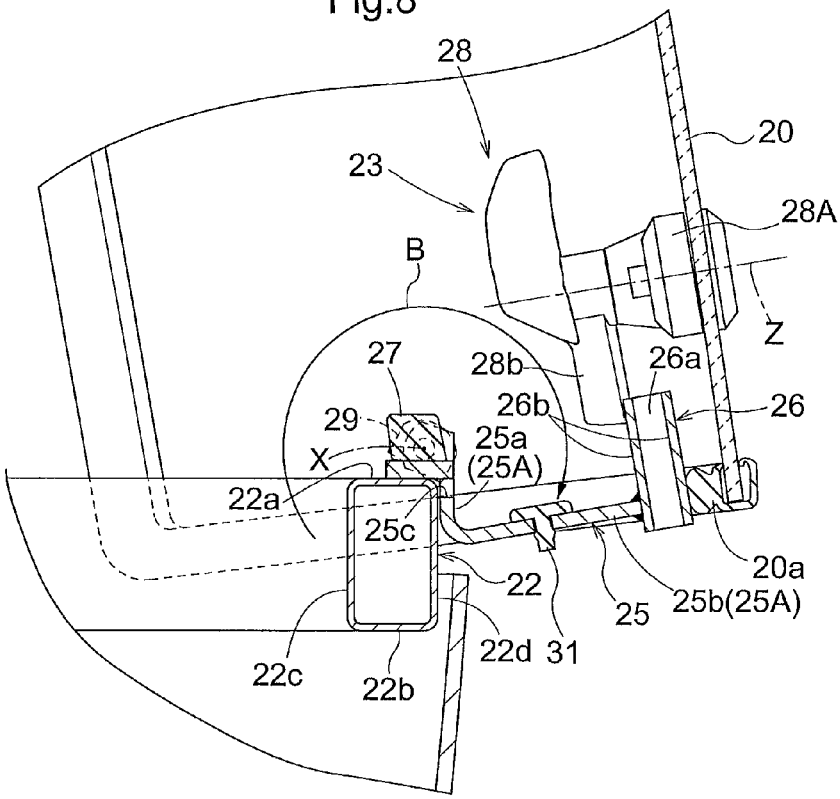
FIG. 8 is a side cross-sectional view showing the locking apparatus when the openable window is in the half-closed state.

As shown in FIGS. 7 and 8, when the lock main body 25 is at the half-closed position, the first arm portion 25*a* opposes an outer face 22*d* of the beam 22, the second arm portion 25*b* extends outward from the beam 22, and the half-lock striker 26 is away from the outer face 22*d* of the beam 22 by a predetermined distance. This predetermined distance realizes the half-closed state of the rear glass 20. When the lock main body 25 is at the half-closed position, the operation piece 28*b* of the handle 28 is positioned such that its face opposing the rear glass 20 can be engaged with the inner flat plate portion 26*b* of the half-lock striker 26.

A cut-out portion 25*c* is formed on the edge portion on the free end side of the first arm portion 25*a* in order to avoid interference with the full-lock striker 27. The full-lock striker 27 is disposed so as to be accommodated in the space inside the swing trajectory of the cut-out portion 25*c* about the swinging axis X, and, thus, the full-lock striker 27 does not obstruct rotation of the lock main body 25 about the swinging axis X.

Next, a method for fixing the rear glass 20 to the fully-closed state and the half-closed state will be described in detail with reference to FIGS. 5 to 8.

Figure 5:
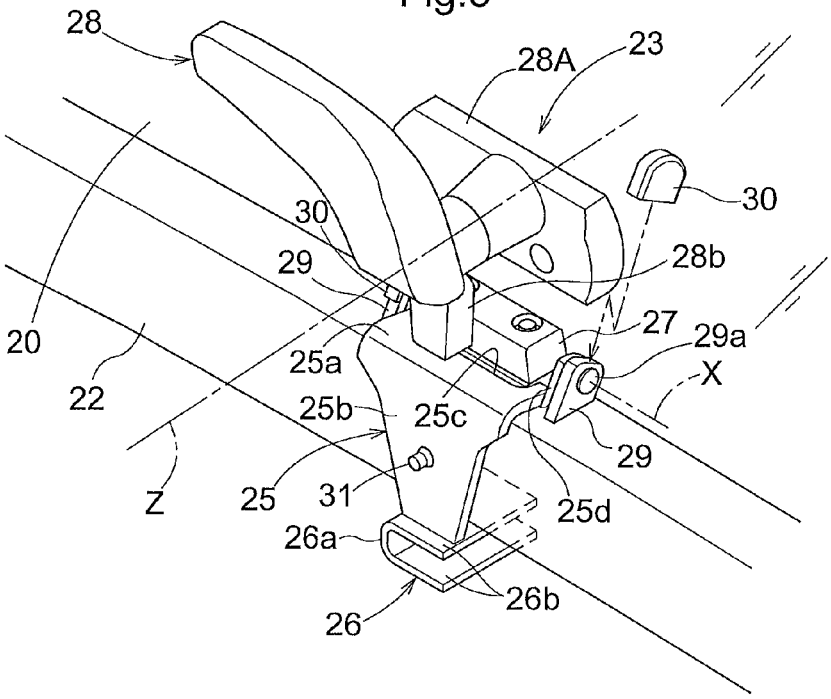
FIG. 5 is a perspective view showing the locking apparatus when an openable window is in a fully-closed (closed) state.
Figure 6:
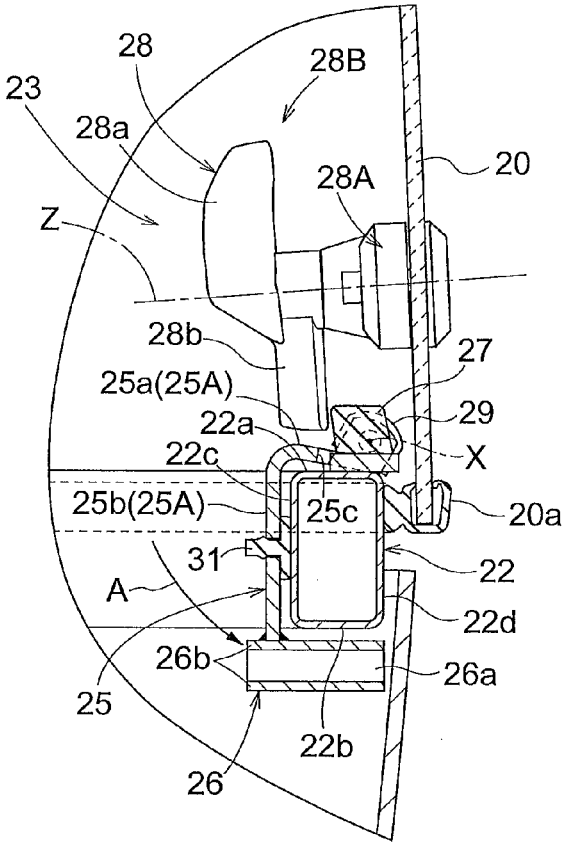
FIG. 6 is a side cross-sectional view showing the locking apparatus when the openable window is in the fully-closed (closed) state.

As shown in FIGS. 5 and 6, when the lock main body 25 is swung downward (as indicated by an arrow A shown in FIG. 6), the lock main body 25 is switched to the closed position where the half-lock striker 26 does not become engaged with the rear glass 20 that is in the fully-closed state.

When the lock main body 25 is at the closed position, the half-lock striker 26 is positioned on the side opposite the swinging axis X of the lock main body 25 such that the lock main body 25 wraps around the beam 22. Accordingly, the half-lock striker 26 is accommodated outside the range of vision (below the beam 22), and the lock main body 25 is made compact, and, thus, when the rear glass 20 is in the fully-closed state, the half-lock striker 26 does not obstruct the vision. Furthermore, the handle 28 can be rotated from a non-operation posture at which the operation piece 28*b* is away from the full-lock striker 27 to an operation posture at which the operation piece 28*b* is in contact with the full-lock striker 27. At the operation posture, the operation piece 28*b* is engaged with the full-lock striker 27, and, thus, the rear glass 20 is kept in the fully-closed state.

A face of the second arm portion 25*b* opposing the beam 22 functions as a stopper face for positioning the lock main body 25 at the closed position, through the contact with the inner face 22*c* of the beam 22. In this embodiment, the second arm portion 25*b* of the lock main body 25 is attached with, as stopper face, a rubber member 31 that can be in contact with the beam 22. When the rubber member 31 is in contact with the beam 22 in a state where the rear glass 20 is fixed to the fully-closed state, a function of preventing vibration of the lock main body 25 is also obtained.

Furthermore, as shown in FIGS. 7 and 8, when the lock main body 25 is swung upward (as indicated by an arrow B shown in FIG. 8), the lock main body 25 is switched to the half-closed position in which the half-lock striker 26 becomes engaged with the rear glass 20 that is in the half-closed state.

When the lock main body 25 is at the half-closed position, the handle 28 can be rotated from a non-operation posture at which the operation piece 28*b* is away from the half-lock striker 26 to an operation posture at which the operation piece 28*b* is in contact with the half-lock striker 26 in a state where the rear glass 20 is kept in the half-closed state by the lock main body 25. At the operation posture, the flat plate portions 26*b* of the half-lock striker 26 are sandwiched between the handle 28 (the operation piece 28*b*) and the rear glass 20, and, thus, the rear glass 20 is kept in the half-closed state. When keeping the rear glass 20 in the half-closed state, the operation piece 28*b* is caused to be engaged with the half-lock striker 26 by the swinging of the handle 28 about the axis Z, and, at that time, the movement of the operation piece 28*b* is guided by the curved face of the convexly curved bottom plate 26*a*. The operation piece 28*b* smoothly moves from the curved face of the convexly curved bottom plate 26*a* to the flat face of the flat plate portion 26*b* as the handle 28 is swung about the axis Z. Specifically, when the handle 28 is rotated counterclockwise in a front view, the operation piece 28*b* moves from above to below, slides on the curved face of the convexly curved bottom plate 26*a*, and is guided to the flat plate portion 26*b*. In this example, a trim 20*a* as a sealing member made of elastic material is disposed on the lower edge portion of the rear glass 20, and the flat plate portions 26*b* of the half-lock striker 26 are sandwiched between the operation piece 28*b* of the handle 28 and the rear glass 20 via the trim 20*a*.

Note that the first arm portion 25*a* functions as a stopper face for positioning the lock main body 25 at the half-closed position, through the contact with the outer face 22*d* of the beam 22. Thus, the first arm portion 25*a* also may be attached with a rubber member.

Although the locking apparatus 23 is applied to the rear glass 20 that is opened by being swung outward in the foregoing embodiment, the locking apparatus 23 according to the invention may be applied to a rear glass 20 that is opened by being swung inward.

Although the locking apparatus 23 is provided in the cabin 6 of a four-column type in the foregoing embodiment, the locking apparatus 23 according to the invention may be provided in a cabin of a six-column type. For example, in the case of a cabin of a six-column type, the locking apparatus 23 according to the invention may be applied to a side glass. In this case, specifically, the side glass can be opened and closed with its front portion being swingably supported, and the locking apparatus 23 is disposed between a rear portion of the side glass and a vertical frame (vertical beam) in the vertical orientation (upper-lower orientation). At that time, the lock main body 25 is swingably supported about a swinging axis (vertical axis) that is along the longitudinal direction (upper-lower direction) of the vertical frame.

What is claimed is:

1. A locking apparatus for an openable window disposed in a cabin provided with a beam that has a first face and a different face from the first face, comprising:

a lock main body that is attached to the first face so as to be pivotable about a center of a swinging shaft formed on a first face side of the beam along an extending direction of the beam between a closed position and a half-closed position;

an operation piece that is attached to the openable window and switchable between an operation posture and a non-operation posture;

a full-lock striker that is attached to the beam and engageable with the operation piece at the operation posture, when the lock main body is at the closed position; and a half-lock striker that is disposed on the lock main body at a point farther from the center of the swinging shaft than is the full-lock striker, the half-lock striker being engageable with the operation piece at the operation posture when the lock main body is at the half-closed position, wherein the operation piece and the lock main body are separated from each other when the operation piece is at the non-operation posture, and the half-lock striker is positioned on a side of the different face from the first face of the beam when the lock main body is at the closed position.

2. The locking apparatus according to claim 1, wherein the lock main body includes a flange portion that is coupled to the swinging shaft, and an arm portion that connects the flange portion and the half-lock striker, and the arm portion is positioned on a side of a face of the beam oriented toward the interior of the cabin when the lock main body is at the closed position, and is positioned on a side of a face of the beam oriented toward the outside of the cabin when the lock main body is at the half-closed position.

3. The locking apparatus according to claim 2, wherein the arm portion, together with the half-lock striker, surrounds the beam when the lock main body is at the closed position.

4. The locking apparatus according to claim 2, wherein the arm portion is configured by a first arm portion that is, at the closed position, positioned on the first face side, and a second arm portion that extends so as to be bent from the first arm portion, the first arm portion has a first stopper face for positioning the lock main body at the half-closed position through contact with the beam, and the second arm portion has a second stopper face for positioning the lock main body at the closed position through contact with the beam.

5. The locking apparatus according to claim 1, further comprising:

a handle that switches the operation piece between an operation posture and a non-operation posture;

wherein the operation piece that is at the operation posture operates on the full-lock striker when the lock main body is at the closed position, so that the openable window is pressed against the beam, and the operation piece that is at the operation posture operates on the half-lock striker when the lock main body is at the half-closed position, so that the openable window is pressed against the lock main body.

6. The locking apparatus according to claim 5, wherein an elastic member is interposed between the beam and the openable window at a closed posture.

7. The locking apparatus according to claim 1, wherein the half-lock striker is a U-profile member configured from a convexly curved bottom plate portion and flat plate portions that extend from the convexly curved bottom plate portion so as to be spaced apart from each other.

8. The locking apparatus according to claim 1, wherein the full-lock striker is attached to the first face of the beam.

9. The locking apparatus according to claim 1, wherein a cut-out portion is formed at an end portion of the lock main body, and the full-lock striker is disposed so as to be accommodated in a space inside a swing trajectory of the cut-out portion about the center of the swinging shaft.

10. The locking apparatus according to claim 1, wherein the first face represents an upper face of the beam and the different face from the first face represents a lower face of the beam.

* * * * *